United States Patent [19]

Frantz

[11] Patent Number: 4,795,380

[45] Date of Patent: Jan. 3, 1989

[54] SELF-LOCKING RING TERMINAL

[75] Inventor: Richard P. Frantz, Hershey, Pa.

[73] Assignee: AMP Incorporated, Harrisburg, Pa.

[21] Appl. No.: 136,674

[22] Filed: Dec. 22, 1987

[51] Int. Cl.[4] ..... H01R 4/48; H01R 13/28

[52] U.S. Cl. ..... 439/860; 439/879

[58] Field of Search ..... 439/860, 859, 883, 861, 439/441, 879, 880

[56] References Cited

U.S. PATENT DOCUMENTS

| | | | |
|---|---|---|---|
| Re. 27,003 | 12/1970 | Rueger | 340/815.14 |
| 1,213,632 | 1/1917 | Hammond | 439/860 |
| 1,386,831 | 8/1921 | Austin | 439/860 |
| 1,921,823 | 8/1933 | Hosking | 439/883 |
| 2,350,765 | 6/1944 | Johnson | 439/879 |
| 2,648,883 | 8/1953 | Dupre | 439/860 X |
| 3,340,494 | 9/1967 | Gutshall | 439/434 |
| 3,622,954 | 11/1971 | Hovnanian | 439/865 |
| 3,728,669 | 4/1973 | Churla | 439/860 X |
| 4,169,653 | 10/1979 | Nix et al. | 439/859 |
| 4,357,070 | 11/1982 | Fukushima et al. | 439/883 X |
| 4,605,279 | 8/1986 | Mixon, Jr. | 439/880 |

FOREIGN PATENT DOCUMENTS

| | | |
|---|---|---|
| 533472 | 9/1972 | Japan . |
| 639575 | 1/1975 | Japan . |
| 31877 | 3/1977 | Japan . |
| 129987 | 10/1977 | Japan . |
| 659918 | 2/1987 | Switzerland . |
| 910530 | 1/1975 | United Kingdom . |
| 2017426 | 9/1979 | United Kingdom . |

*Primary Examiner*—William R. Briggs

*Attorney, Agent, or Firm*—Robert W. Pitts

[57] ABSTRACT

A stamped and formed ring tongue terminal having a latch initially in the plane of the ring tongue, especially adapted to retain the ring tongue terminal to a stud or binding post received within a hole in the ring tongue. The inner end of the latch extends into the hole in the ring tongue and is deflected out of the plane of the ring tongue by engagement with the periphery of the stud or post. The hole in the ring tongue is offset from the wire barrel so that a plurality of terminals can be positioned on the same post with the wires and crimp barrels being side-by-side while the latches will nest.

5 Claims, 4 Drawing Sheets

Fig. 4A
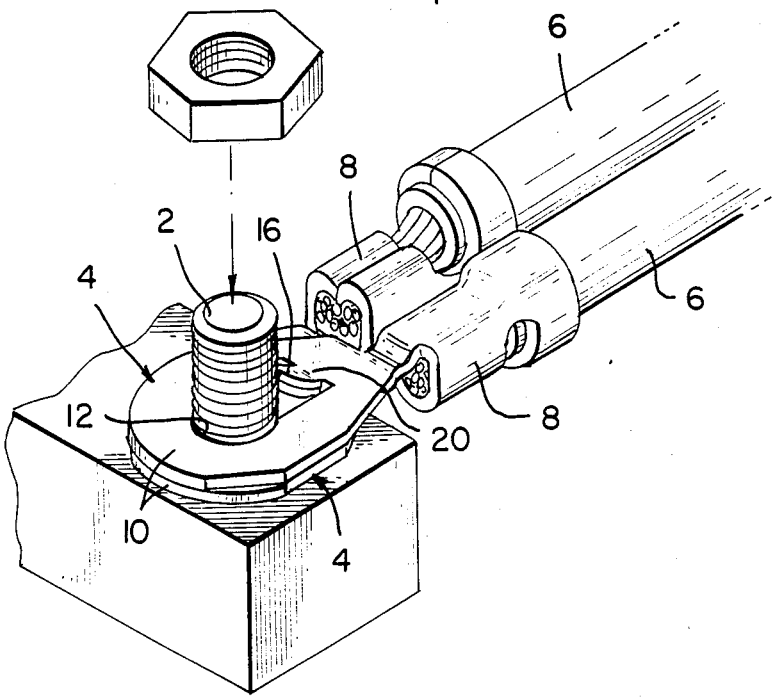
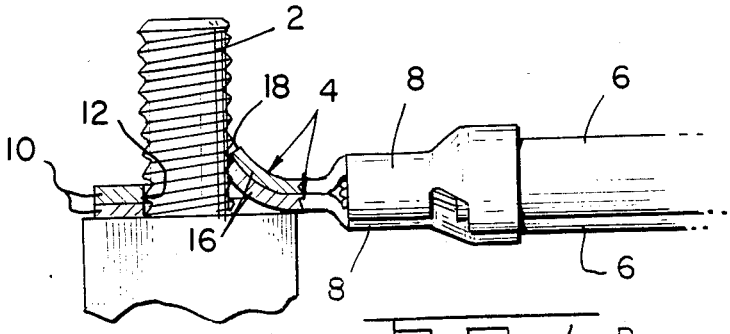
Fig. 4B

SELF-LOCKING RING TERMINAL

BACKGROUND OF THE INVENTION

1. Field of the Invention

This invention relates to electrical terminals adapted to be crimped to a conductor and positioned in engagement with an upstanding stud and particularly relates to ring tongue type terminals having a wire crimp ferrule which can be crimped to the stripped ends of an insulated conductor.

2. Description of the Prior Art

Ring tongue type terminals, such as those shown in U.S. Pat. No. 4,605,279, have long been employed to establish an electrical connection between an insulated wire and a free-standing binding post or upstanding stud. Conventional ring tongue terminals provide a simple and economical electrical interconnection. Ring tongue type terminals can be secured to threaded studs and a nut can be secured to the stud to hold the terminal to the stud and to establish a satisfactory electrical interconnection.

Conventional ring tongue terminals are normally crimped to stripped ends of insulated wires. Open barrel or closed barrel crimps can be used, depending upon the requirements of the specific interconnection. Suitable application tooling is conventionally available to permit automated stripping of the conductors and efficient crimping of the terminals to the stripped conductor ends.

Conventional ring tongue terminals are available in a large number of variations including terminals having a pre-insulated wire crimp, terminals having a generally circular stud contact surface, terminals having a square or rectangular tongue, terminals having the hole in the contact tongue in alignment with the axis of the wire barrel, or terminals having the hole in the contact tongue transversely or offset from the axis of the wire crimp ferrule. Prior art publications also disclose ring tongue terminals having internal teeth projecting from the plane of a circular ring tongue along the inner edge of the binding hole.

SUMMARY OF THE INVENTION

The instant invention comprises an improved stamped and formed ring tongue terminal for use in connecting a conductor to an upstanding stud and is particularly useful for applications in which the ring tongue terminal is applied to the post or stud or by an automated assembly process. This invention provides means of securing the ring tongue terminal to the post so that it will be locked into place and will not tend to work up or come off of the stud due to vibration, especially as a result of vibrations during an automated assembly line process prior to the time the terminal is permanently secured to the stud or binding post.

This improved ring tongue terminal includes conventional means for terminating the wire or conductor to the terminal, such as a conventional open barrel terminal. Note that closed barrel terminals could also be employed. A stud contact or ring tongue normally comprises a flat plate having a hole extending therethrough. A latch is stamped in the ring tongue plate with the inner end of the latch extending beyond the circular inner edge of the hole in the ring tongue plate. Normally, the latch is in the plane of a flat plate ring tongue and the inner end of the latch has a circular contour. When the ring tongue terminal is positioned on a stud with the stud being inserted through the hole in the ring tongue, the latch will engage the periphery of the stud and be deflected during insertion of the terminal onto the stud. Thus, the tongue will be upwardly deflected when the ring tongue is moved downwardly onto the stud or binding post. The inner end of the latch will engage the stud or binding post to resist removal of the ring tongue terminal from the binding post. Note that the use of a latch deflectable relative to the plane of the ring tongue, and initially in the plane of the ring tongue, permits insertion of the ring tongue onto the stud in either of two reversely oriented positions. In other words, the ring tongue can be inserted upside down onto the binding post. The latch will still be deflected upwardly by downward motion of the ring tongue terminal, regardless of whether the terminal is inserted right-side up or upside down.

When a latch of this configuration is employed with a ring tongue terminal having a hole in the ring tongue offset from the wire crimp barrel, a plurality of terminals can be applied to a single binding post or stud in stacked relationship, and the height of the stack of terminals can be reduced. Offset terminals having a latch of this configuration, when reversely oriented, will position the wire barrels in side-by-side relationship, but the latch of adjacent terminals will be in a nested relationship. Thus, the height of the stack of terminals is reduced and any tendency of the terminals to work their way off of the ring tongue, which would be exaggerated with respect to terminals adjacent the top of the binding post, would be eliminated by the latch.

BRIEF DESCRIPTION OF THE DRAWINGS

FIG. 3 is a view of a terminal mounted on a stud showing deflection of the latch as a result of insertion of the terminal onto the stud as distinguished from a terminal about to be inserted onto the stud in which the latch is in the plane of the ring tongue.

FIGS. 4A and 4B show the nested latches of adjacent terminals in a stacked relationship.

DETAILED DESCRIPTION OF THE PREFERRED EMBODIMENT

Figure 1:
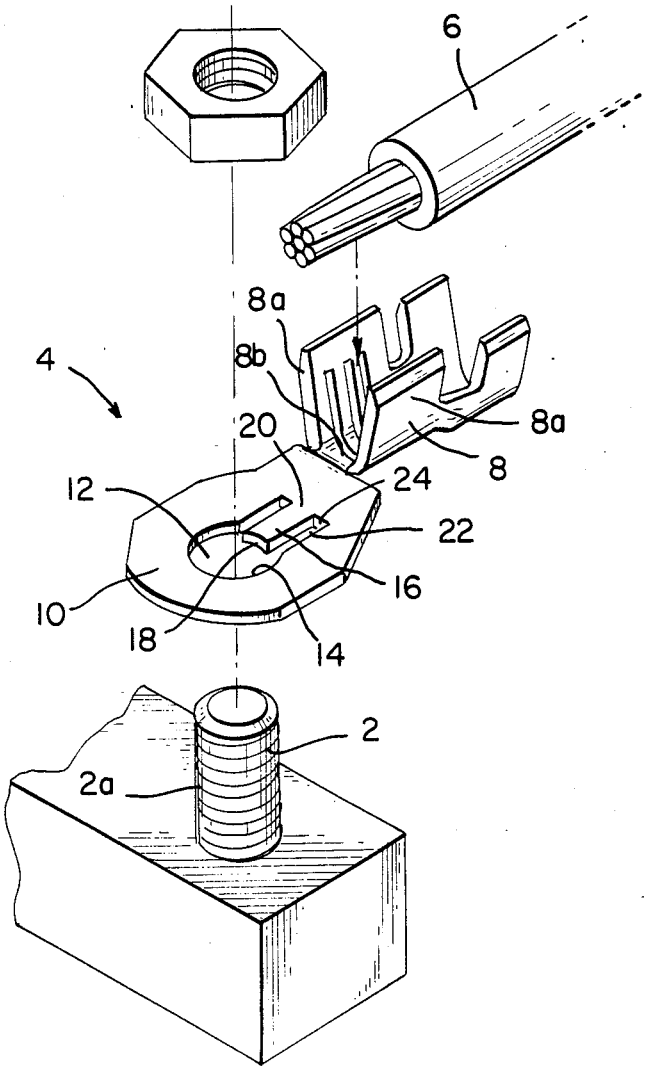
FIG. 1 is a perspective view of a stamped and formed terminal having an open barrel suitable for crimping an uninsulated end of a wire and having a ring tongue with an offset hole and a latch shown initially in the plane of the ring tongue.
Figure 2:
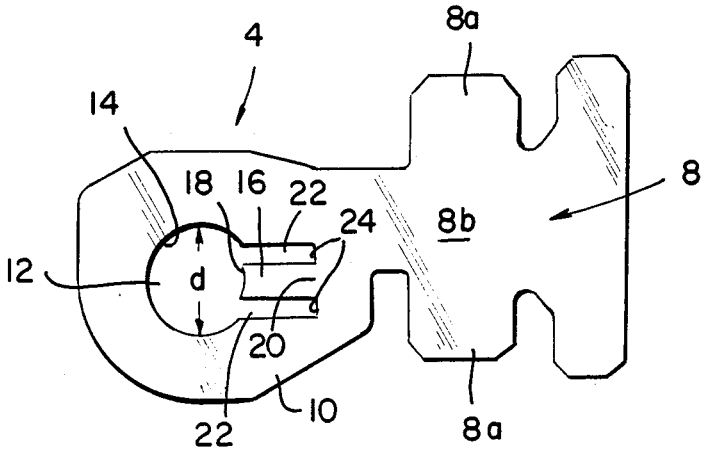
FIG. 2 is a plan view of the ring tongue showing the latch protruding into the hole.

The ring tongue terminal 4 comprising the preferred embodiment of this invention can be stamped and formed from any number of conventional materials used for electrical interconnection purposes and is employed to establish a connection between a conductor, such as a wire 6 having a free end with the insulation removed or stripped therefrom, to a conventional upstanding stud or binding post 2. In the embodiment depicted herein, a stud 2 having threads **2*a* for receipt of a nut to permanently secure one or more terminals in electrical engagement with the stud is employed. The ring tongue terminals of the type employed herein are attached to studs or binding posts, which can extend from an electrical component, simply by inserting the ring tongue over the free end of the stud with the stud being received in the hole 12 of the terminal 4**.

The stamped and formed terminal 4 has a conventional wire crimp barrel 8 and a stud contact or ring tongue 10 extending therefrom. Terminals of this type are conventionally stamped and formed from a flat stock of electrically conductive metal. The preferred embodiment of the invention depicted herein has an open barrel wire crimp 8 having upstanding wings 8*a* extending from opposite edges of a central root section 8*b*. It should be understood, however, that a closed barrel crimp or other conventional terminating means can be employed with a terminal of this type.

The wings 8*a* of the open barrel crimping section 8 extend above the root section 8*b* in the configuration of FIG. 1 and, when crimped to the wire 6, as shown in FIG. 3, both the wire and the crimp will be above the plane of the ring tongue or stud contact 10 which extends from one end of the root section 8*b* of the crimp barrel 8.

In the preferred embodiment of this invention, the ring tongue or stud contact 10 comprises a flat plate section having a hole 12 having an inner circular edge 14 of diameter "d". The center of hole 12 is offset from the open barrel crimping section and thus will be offset from a wire positioned within the crimp barrel 8.

A latch 16 is stamped into the stud contact or ring tongue 10 on one side of the hole 12. Latch 16 comprises a cantilever member which is initially in the plane of the flat plate of said contact 10. The inner free end 18 of the latch 16 protrudes inwardly beyond the circular edge 14 of hole 12. In one embodiment of this invention, inner latch end 18, which has a circular contour, extends inwardly beyond the circular edge 14 by a distance of 0.010 inch. The extent of this dimension will, however, depend upon the specific screw or post diameter tolerance. For example, this dimension could easily be 0.015 inch. Thus, the diameter of the arcuate contour of the inner end 18 will be less than the nominal internal diameter of the circular inner edge 14 which extends only partially around the circumference of the hole 12. In other words, the circular edge 14 having a nominal internal diameter of "d" is spaced from the center of the hole by a distance greater than the arcuate contour of the inner latch end 18.

Figure 5:
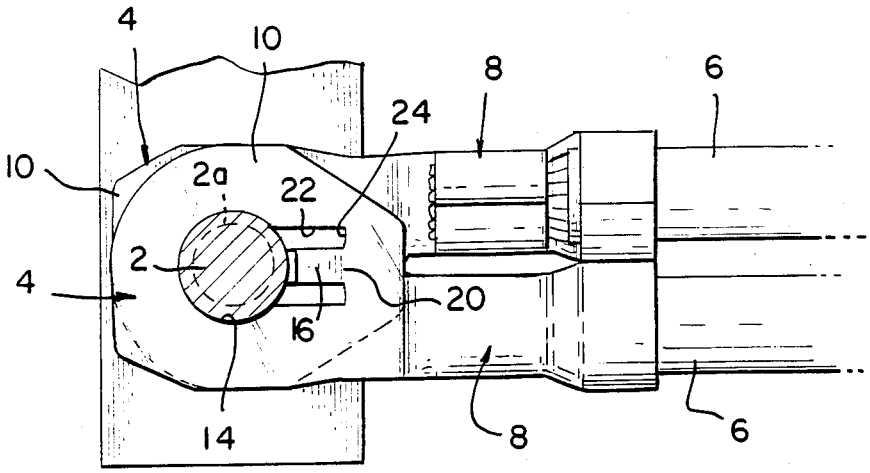
FIG. 5 is a plan view of two terminals in stacked relationship on a single stud showing the wire crimp barrel in side-by-side relationship resulting from the use of an offset hole in the ring tongue.
Figure 7:
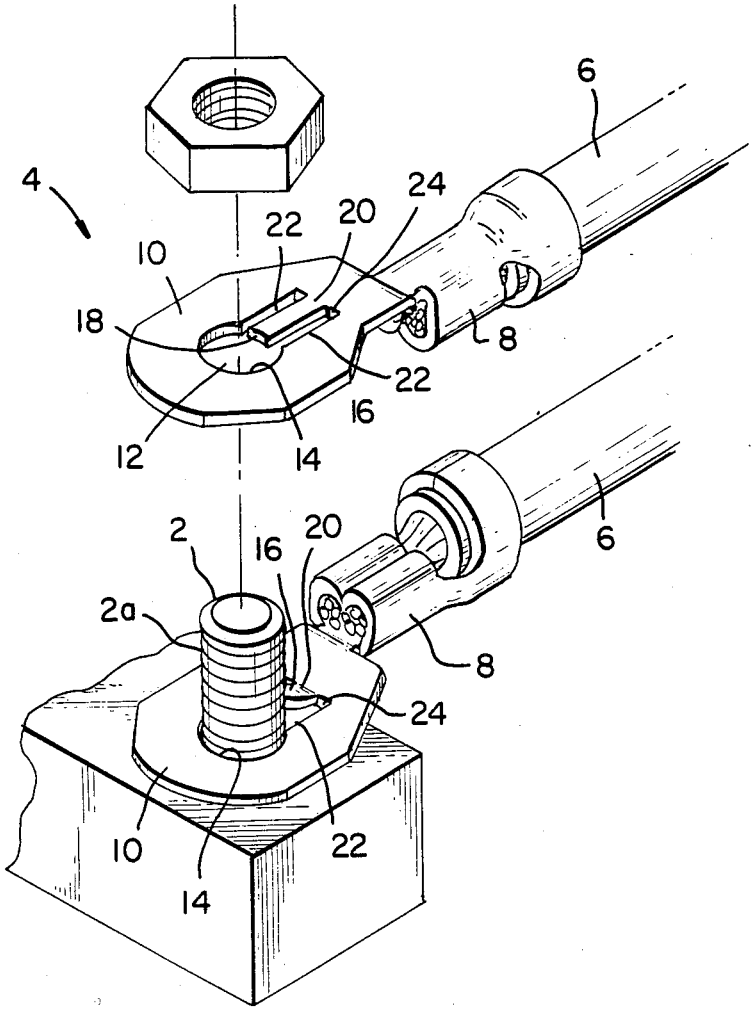

In the preferred embodiment of this invention, the latch 16 is defined by stamping slots 22 into the plate of the stud contact 10 to define the edges of the latch 16. The root 24 of slots 22 will be located adjacent the base 20 of latch 16 so that latch 16 comprises a cantilever member initially in the plane of the flat plate. When the hole 12 is offset from the axis of the crimp barrel 8, and thus offset from the crimped wire 6, this invention is especially useful in an assembly consisting of a plurality of terminals positioned in stacked relationship on a single stud or binding post. When adjacent terminals in the stacked relationship are reversely oriented, that is one upside down and the other right-side up, the crimp barrels 8, and thus the wires 6 crimped to terminals 4, will be laterally offset and indeed can extend in a parallel relationship even though each is assembled to the same binding post or stud 2. This relationship is seen in FIG. 5. Since the latch 16 is initially in the plane of the ring tongue or stud contact 10 and is deflectable in either direction relative to the plane of the stud contact 10, the latch 16 in either terminal will be deflected upwardly when the terminal is moved downwardly relative to the stud 2. Thus, the terminal inserted onto a binding post with the wire 6 above the plane of the ring tongue will have a latch 16 deflected upwardly toward the wire 6 while a terminal inserted onto a stud 2 with the wire 6 below the plane of the stud contact or ring tongue 10 (upside down) will have a latch which protrudes from the plane of the stud contact or ring tongue 10 on the side opposite from the wire 6. Even though latches 16 on adjacent terminals in stacked relationship can deflect in opposite directions relative to the plane of the ring tongue or stud contact 10, these latches will nevertheless be deflected in the same absolute direction and the latches will nest in overlapping relationship, as shown in FIGS. 4A and 4B. The mutually offset crimp barrels of adjacent terminals in stacked relationship could be positioned side-by-side with the ring tongues or stud contacts 10 overlapping and being in contact with each other, thus reducing the overall height of the plurality of stacked terminals.

Engagement of the inner end 18 of latch 16 with the stud outer diameter thus serves to retain each individual stamped terminal on appropriate studs 2. In the preferred embodiment of this invention, this configuration is used to retain the terminals to the stud during an automated assembly operation. One of ordinary skill in the art would appreciate that this latching configuration could be employed both to provide retention of the terminal onto a post or stud and also to engage the post or stud to establish intimate electrical contact therewith. One of ordinary skill in the art could design such a terminal having appropriate dimensions and material properties to form an adequate electrical contact as well as to retain the terminal on a stud. Therefore, the following claims are not limited to the preferred embodiment of the invention depicted herein, but would encompass other embodiments which would be taught to one of ordinary skill in the art by the disclosure of this invention.

I claim:

1. An improved stamped and formed ring tongue terminal, individual terminals being suited for use in connecting a wire to an upstanding stud to which a plurality of terminals can be attached in stacked relationship, each terminal comprising:

a crimp barrel for terminating the wire to the terminal; and a stud contact comprising a flat plate having a hole offset from the crimp barrel;

the improvement comprising a latch stamped from the stud contact flat plate and offset from the wire in the crimp barrel, the latch extending into the hole, the latch being initially in the plane of the flat plate and being deflectable both upwardly and downwardly out of the plane of the flat plate, whereby upon inserting the terminal on the stud, the latch in deflected from the plane of the flat plate and engages the stud to retain the terminal on the stud, adjacent terminals in stacked relationship being reversely oriented with latches on adjacent terminals being deflected in opposite directions relative to the stud contact flat plate, latches on adjacent terminals being adapted to nest in overlapping relationship, crimp barrels in reversely oriented adjacent terminals in stacked relationship being mutually offset whereby the height of the plurality of terminals in stacked relationship can be reduced.

2. The terminal of claim 1 wherein the latch comprises a cantilever member having an arcuate inner end, the hole being by a circular edge, the arcuate inner end protruding inwardly beyond the circular edge of the hole.

3. The terminal of claim 2 wherein the latch comprises a cantilever member joined to the flat plate at a base, the base being opposite from the latch inner end.

4. The terminal of claim 3 wherein slots are stamped on each sides of the latch, separating the latch from the flat plate on the sides of the latch, the slots extending to the base of the latch.

5. An assembly comprising an stud with a free end and a plurality of terminals being attached in stacked relationship, each terminal comprising a stamped and formed ring tongue terminal having a crimp barrel terminating a wire to the terminal and a stud contact flat plate having a hole so that each terminal can be inserted onto the stud over the free end, each hole being offset from the the crimp barrel, each terminal connecting a wire to the upstanding stud;

each terminal having a latch stamped from the stud contact flat plate and offset from the wire in the crimp barrel, the latch being initially in the plane of the flat plate and being deflected out of the plane of the flat plate toward the free end of the stud and engaging the stud to retain the terminal on the stud;

adjacent terminals in stacked relationship being reversely oriented with latches on adjacent terminals being deflected in opposite directions relative to the stud contact flat plate;

latches on adjacent terminals being nested in overlapping relationship, crimp barrels in reversely oriented adjacent terminals in stacked relationship being mutually offset whereby the height of the plurality of terminals in stacked relationship can be reduced.

* * * * *